US006512441B1

(12) United States Patent
Yu

(10) Patent No.: US 6,512,441 B1
(45) Date of Patent: Jan. 28, 2003

(54) PUSH-BUTTON SWITCH OF OVERLOAD PROTECTION (II)

(76) Inventor: Tsung-Mou Yu, No. 4, Alley 2, Lane 23, Sec. 3, Pa-Te Road, Pan-Chiao City, Taipei Hsien (TW)

( * ) Notice: Subject to any disclaimer, the term of this patent is extended or adjusted under 35 U.S.C. 154(b) by 320 days.

(21) Appl. No.: 09/602,782

(22) Filed: Jun. 23, 2000

(30) Foreign Application Priority Data

Jun. 24, 1999 (TW) ..... 88210455 U

(51) Int. Cl.[7] ..... H01H 37/02; H01H 37/32; H01H 37/46

(52) U.S. Cl. ..... 337/37; 337/39; 337/59; 337/85; 337/112; 337/113; 337/66; 337/74

(58) Field of Search ..... 337/333, 334, 337/345, 379, 66–69, 53, 59, 74, 75, 76, 79, 39, 85, 91, 112, 113, 140; 200/55.3–557

(56) References Cited

U.S. PATENT DOCUMENTS

| | | | | | |
|---|---|---|---|---|---|
| 3,358,099 | A | * | 12/1967 | Bellomayre | 200/113 |
| 4,092,623 | A | * | 5/1978 | Kirkup | 337/66 |
| 4,258,349 | A | * | 3/1981 | Flory | 337/46 |
| 4,345,233 | A | * | 8/1982 | Matthies | 337/75 |
| 4,528,538 | A | * | 7/1985 | Andersen | 337/43 |
| 4,661,667 | A | | 4/1987 | Sorimachi et al. | 200/314 |
| 4,704,594 | A | | 11/1987 | Krasser | 337/66 |
| 4,931,762 | A | * | 6/1990 | Fierro | 337/66 |
| 4,937,548 | A | | 6/1990 | Sdunek | 337/70 |
| 5,012,495 | A | * | 4/1991 | Munroe et al. | |
| 5,223,813 | A | | 6/1993 | Cambreleng et al. | 337/66 |
| 5,262,748 | A | * | 11/1993 | Tsung-Mou | 337/66 |
| 5,451,729 | A | * | 9/1995 | Onderka et al. | 200/18 |
| 5,541,569 | A | * | 7/1996 | Jang | 337/68 |
| 5,760,672 | A | * | 6/1998 | Wang | 337/79 |
| 5,786,742 | A | | 7/1998 | Yin | 337/66 |
| 5,828,284 | A | * | 10/1998 | Huang | 337/37 |
| 5,847,638 | A | * | 12/1998 | Sorenson | 337/380 |
| 5,889,457 | A | * | 3/1999 | Hsu et al. | 337/59 |
| 5,892,426 | A | * | 4/1999 | Huang | 337/59 |
| 5,898,355 | A | * | 4/1999 | Yu | 337/8 |
| 6,072,381 | A | * | 6/2000 | Yu | 337/37 |
| 6,094,126 | A | * | 7/2000 | Sorenson | 337/37 |
| 6,121,868 | A | * | 9/2000 | Chiang | 337/37 |
| 6,154,116 | A | * | 11/2000 | Sorenson | 337/37 |
| 6,229,426 | B1 | * | 5/2001 | Lavado et al. | 337/57 |

FOREIGN PATENT DOCUMENTS

| | | | | | |
|---|---|---|---|---|---|
| CH | 647094 | A5 | * | 12/1984 | 337/333 |
| DE | 19534611 | A1 | * | 3/1996 | H01H/23/20 |
| EP | 0694947 | A1 | * | 1/1996 | H01H/71/54 |

* cited by examiner

*Primary Examiner*—Anatoly Vortman

(57) ABSTRACT

A push-button switch with overload protection is disclosed. The switch comprises a housing, a conducting unit, and an actuating unit. The conducting unit comprises several terminals, a normal-open first conducting leaf and a thermally deflecting bimetal sheet. The bimetal sheet is of a U shape having a working end and an opening end. The working end can deflect to an overload position from a normal position in the event of overload. The actuating unit comprises a stem, a positioning means, a rocking lever, an enabling lever, and a lever reseating member. By means of the above structure, a trip action could be assured no matter what happens on the stem.

5 Claims, 9 Drawing Sheets

PUSH-BUTTON SWITCH OF OVERLOAD PROTECTION (II)

BACKGROUND OF THE INVENTION

The present invention relates to a push-button switch and, in particular, to a push-button switch having a simple structure incorporated with an overload protection function.

There are many kinds and types of push-button switches for various applications, such as one having a turn-on indicating lamp and one provided with an overload protection function. In terms of one having an overload protection function, there are also several kinds of protection principles or mechanisms being adopted. For example, both the blow-out of a fuse wire and the thermal deformation of a bimetal blade have ever been adopted as a trigger source for an overload protection. However, the fuse wire is not repetitive and thus its utility rate gradually decreases. As for the thermal bimetal blade, there are many kinds of mechanism, such as those disclosed in U.S. Pat. Nos. 5,786,742, 5,223,813, 4,937,548, 4,661,667, 4,931,762, 5,451,729, and 4,704,594.

For example in the U.S. Pat. No. 5,786,742, a so-called power-cutting member (72) used to alternatively set a set and a reset positions of a switch is disclosed. In that case, a bimetallic blade (75) is used to push a shaft seat (71) to trip and automatically reset a switch, and a button depresses contacts directly. Thus, if the button has jammed or pushed down by an external force, they would be kept in its conducting position even if overload occurs. Moreover, such a switch is not economical because of a use of up to four contacts to construct a conducting circuit. The possibility of generating an arc also increases. Furthermore, such a switch is troublesome to provide a wire connecting the bimetallic blade (75) with the conducting plate (74).

In U.S. Pat. No. 5,223,813, a bimetal beam (13), a common trip (17) actuated by the bimetal beam, a cam member (27), and a rocker actuator (33) are used to construct a circuit between contact members (7,1). In such a switch, the common trip (17) can result in a displacement in response to the deformation of the bimetal beam so as to release the cam member and to trip the switch. Moreover, neither a jamming of the rocker actuator nor a neglectful re-push on the switch after the event of overload has influence on its overload protection, because the rocker actuator indirectly actuates the common trip. However, such a switch is rather complicated. Moreover, since it needs a wire to be connected to its cantilever spring (5) and its bimetal beam (13), its assembly is also troublesome. Furthermore, a fail-action could possibly happen when overload occurs since the bimetal beam may be not able to simultaneously actuate the rocker actuator (33) and the common trip (17).

In U.S. Pat. No. 4,937,548, a circuit breaker that utilizes the deformation of a thermal actuator (76) to displace a lock lever (62) so as to release a bell crank lever operator (52) is disclosed. In this case, the actuator indirectly actuates a movable contact (86), and thus a jamming of the actuator and a re-push on the switch in case of overload can be avoided. However, such an arrangement is inconvenient to install an indicating lamp. In U.S. Pat. No. 4,661,667, a double-heart-shaped-shaped cam locking mechanism is used to obtain two locking-positions. However, such a switch lacks an overload protection function as well as a status-indicating function.

SUMMARY OF THE INVENTION

A main object of the present invention is to provide a push-button switch that has a simple structure and can obtain an exact protection action.

Another object of this invention is to provide a push-button switch having an overload protection mechanism capable of complying with any types of bimetal sheets without a need of high assembly accuracy.

To achieve the objects of this invention, this invention discloses a push-button switch with overload protection comprising:

a housing;

a conducting unit installed in the housing and including a first terminal, a second terminal, a first conducting leaf, and a flat bimetal sheet; the bimetal sheet having a movable working end, being able to deflect to an overlord position upon overload from a normal position, and a fixed opening end formed with a first and a second legs for respectively connecting with the first terminal and the first conducting leaf; the first conducting leaf being movable between a normal-open position in which the second leg is disconnected from the second terminal and a closed position in which the second leg is electrically connected to the second terminal; and an actuating unit installed in the housing and including:

a stem to be actuated;

a positioning means includes a heart-shaped stepping recess and a locating cantilever for alternatively locating the stem in an upper reset position and a lower set position with respect to the housing;

a rocking lever pivotally supported on the stem along a pivoting axle and formed with a nose for depressing the conducting leaf and a resting tail opposite to the nose across the pivoting axle;

an enabling lever formed with a rotating center pivotally mounted on the housing, an engaging head for engaging with the working end of the bimetal sheet, and an enabling rest for supporting the resting tail and thus enabling the rocker lever; and a lever reseating member for pushing the rocking lever into an idle position in which the resting tail can be supported by the enabling rest, during a reset course in which the stem moves from the set position to the reset position;

whereby the nose can depress and release the conducting leaf so as to make the latter move into the closed position and the normal-open position in response to the movement of the stem to its set position and its reset its reset position, respectively, in case the resting tail is supported by the enabling rest, and whereby the first conducting leaf can move to its normal-open position in response to a change of the bimetal sheet into its overload position.

According to the above structure, the switch could exactly trip in the event of overload, and one should manually reset the switch before turn it on again. Thus, it is easy to recognize whether an event of overload happens at an interval of power-off in the light of the position of the switch. Moreover, by virtue of the enabling lever, the positional relationship between the rocking lever and the bimetal sheet is easily accommodated.

BRIEF DESCRIPTION OF THE DRAWINGS

In the following, preferred embodiments of the present invention will be described in detail in conjunction with the accompanying drawings, wherein.

DETAILED DESCRIPTION OF THE INVENTION

Figure 1:
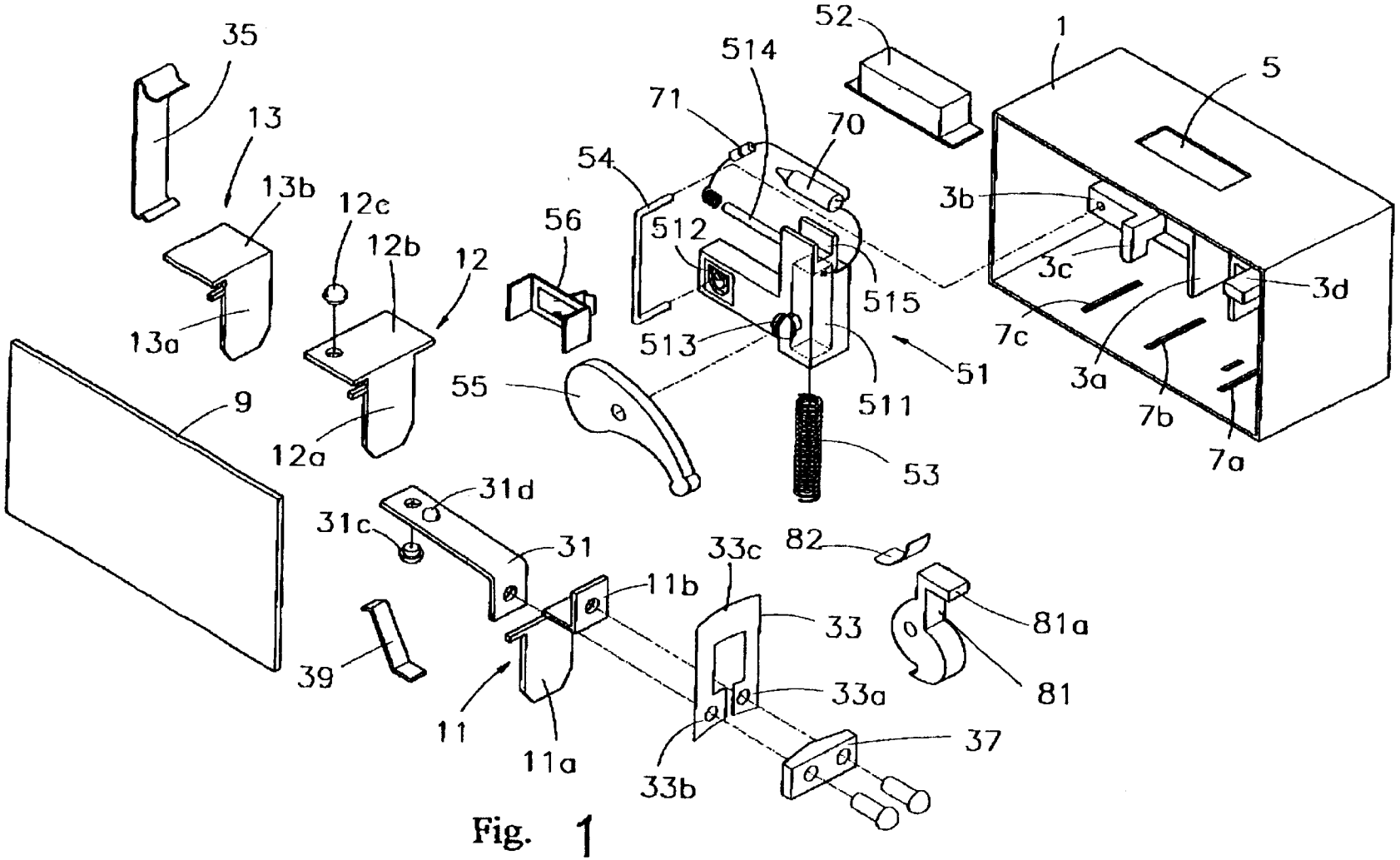
FIG. 1 is a perspective exploded schematic view of a push-button switch with overload protection in accordance with a first embodiment of this invention.

As shown in FIG. 1, the push-button switch with overload protection in accordance with a first embodiment of this invention generally comprises a conducting unit, an actuating unit, and a housing for receiving all the foresaid and the other elements.

The housing mainly consists of a shell 1 and a cover 9. The shell 1 has five walls and is formed with a button hole 5 in a top wall thereof, and three terminal holes 7*a*, 7*b*, 7*c* in a bottom wall thereof. Moreover, it is provided in the shell 1 with a stem guide 3*a*, a cantilever holder 3*b*, a lever reseating pin 3*c*, a biasing spring holder 3*d*, and a snap shaft 3*e*, which are all integrally formed therein (as shown in FIG. 2).

The conducting unit comprises a first terminal 11, a second terminal 12, a third terminal 13, a first conducting leaf 31, a flat thermal-deflecting bimetal sheet 33, a second conducting leaf 35, a lamp 70, and a resistor 71. The terminals 11, 12, 13 respectively includes an inserting portion 11*a*, 12*a*, 13*a* to be received in one of the terminal holes 7*a*, 7*b*, 7*c* and a tab portion 11*b*, 12*b*, 13*b* for conducting other conducting elements to construct a circuit loop. The first and third terminals 11, 13 are usually used to connect with an external power source. A static lower contact pad 12*c* is secured in a hole formed in the tab portion 12*b* of the second terminal 12 for contacting a movable upper contact pad 31*c* mentioned below.

The bimetal sheet 33 is of a reversed-U shape having a returning end and an open end formed with two legs 33*a*, 33*b*. The returning end is movable and functions as a working end. The two legs 33*a*, 33*b* are fixed by an insulating block 37 such that the surfaces of the two legs slant to each other at a certain angle. The leg 33*a* is electrically connected to the first terminal 11.

Figure 2:
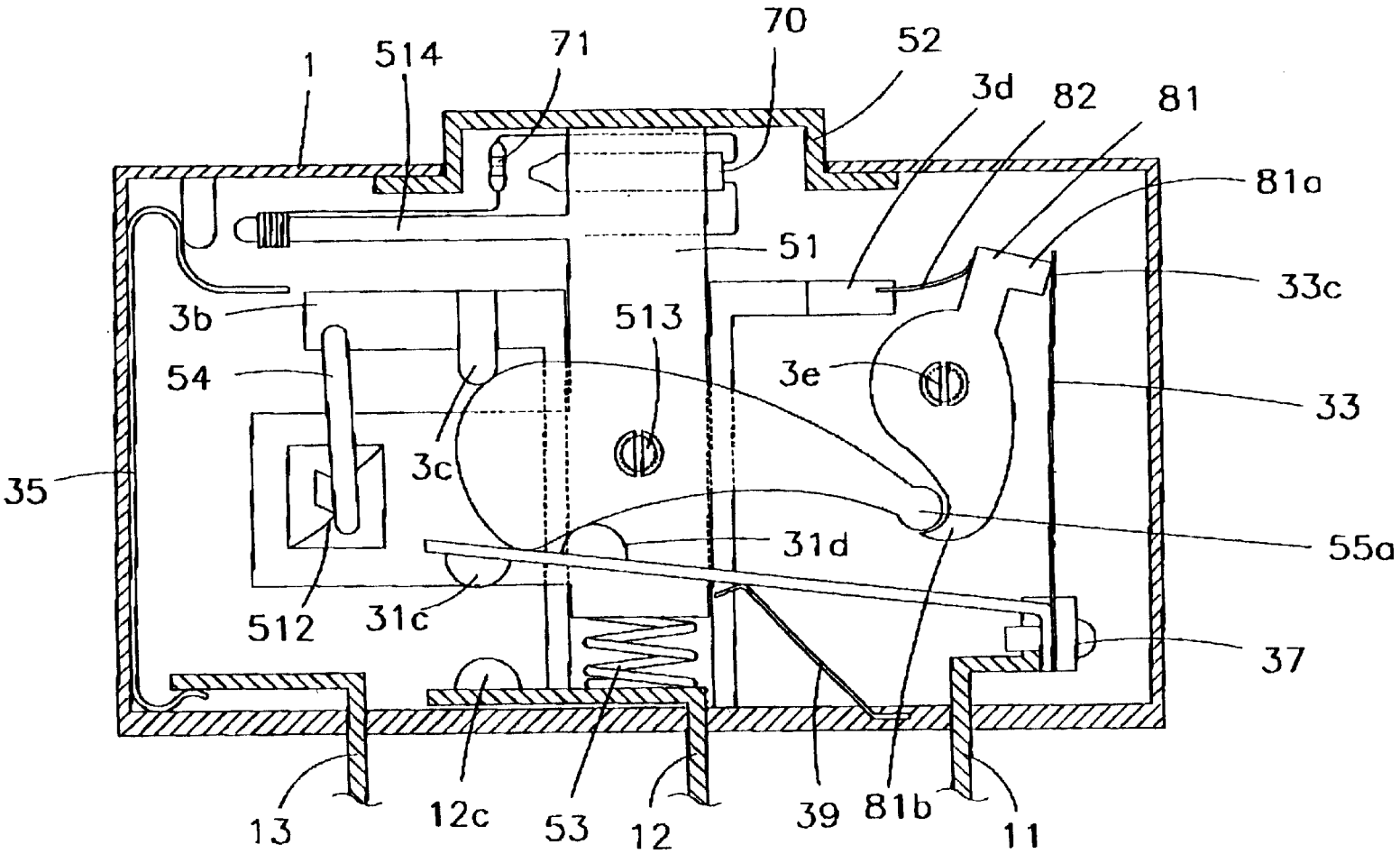
FIG. 2 is an assembled elevation view, partly in section, of the push-button switch of FIG. 1 in an OFF status.
Figure 4:
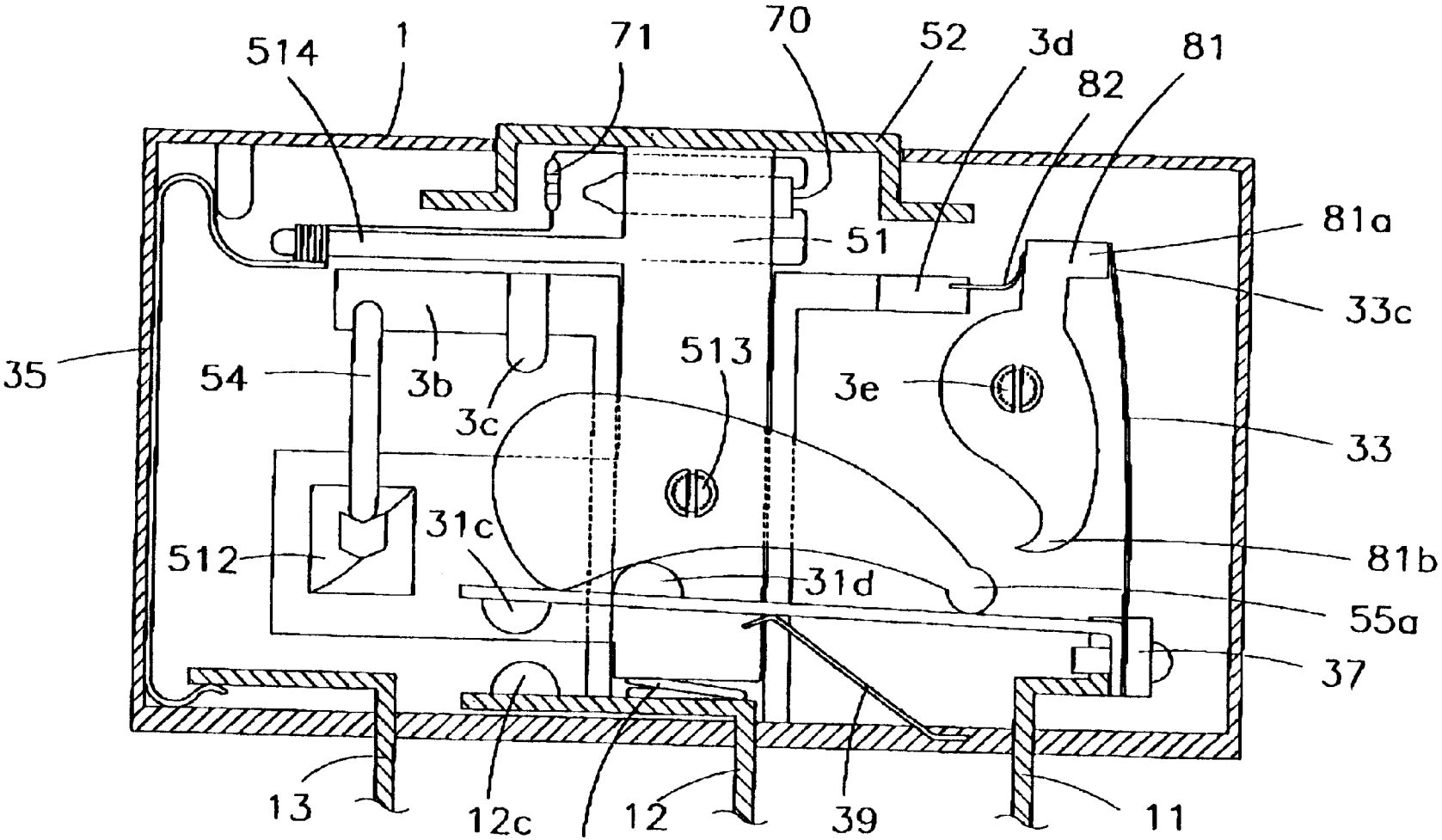
FIG. 4 is a view similar to FIG. 2 except in a trip status.

By virtue of the above arrangement, the working end of the bimetal sheet 33 will transiently deflect to a leftward-curved overload position as shown in FIG. 4 from a rightward-curved normal position as shown in FIG. 2 in case the overload current is beyond a threshold point.

In an alternative modification, the insulating block 37 can be omitted inasmuch as the two legs can be fixed. Moreover, the surfaces of the two legs can be in the same plane.

The first conducting leaf 31 is made of a flat metallic plate and has a fixed end and a free end, the fixed end being electrically connected to the leg 33*b* of the bimetal sheet 33. The free end of the first conducting leaf 31 is attached with an upper contact pad 31*c* and is capable of moving between a closed/conducting position in which the upper contact pad 31*c* and the lower static contact pad 12*c* contact each other and an open/breaking position in which the two contact pads 31*c* and 12*c* stand apart from one other. The free end of the first conducting leaf 31 is biased toward the open position by a return spring 39 inserted into the shell 1. The middle portion of the first conducting leaf 31 is formed with a dome 31*d* on its upper surface for bearing a depression from the actuating unit. However, it is realizable that the dome 31*d* and the return spring 39 are omissible.

The second conducting leaf 35 is used to connect the third terminal 13 with the lamp 70. One end of the second conducting leaf 35 is fixed by and in conduction with the tab portion 13*b* of the third terminal 13. The other end of the second conducting leaf 35 extends upward along the sidewall of the shell 1 and is fixed by a post (not designated) protruding from the top wall of the shell 1.

The actuating unit comprises a stem 51 slidably mounted in the shell 1, a button 52 mounted on the top of the stem 51 so as to be actuated, a coil spring 53 for biasing the stem 51 upward, a positioning means including a locating cantilever 54 and a heart-shaped stepping recess 512 for locating the stem 51, a rocking lever 55 pivotally supported by the stem 51 for depressing the first conducting leaf 31, and an enabling lever 81 for enabling/disabling the rocking lever 55.

The stem 51 is provided with a body portion 511, a snap catch 513 integrally formed on a front surface of the body portion 511, a branch 514 integrally extending from an upper side surface of the body portion 511, and a slot 515 formed on a top surface of the body portion 511 for receiving the lamp 70. Moreover, the heart-shaped stepping recess 512 is formed in one piece with the body portion 511, as shown in FIG. 1.

The body portion 511 is guided by the guide 3*a* and is formed with an internal cavity (not designated) opening downward for receiving the coil spring 53, and a hole 516 in a sidewall thereof for the pass of the lamp 70 into the cavity from the outside thereof. The map catch 513 is provided for pivotally supporting the rocking lever 55 along a pivotal axle. The branch 514 is used to carry one leg of the resistor 71 into contact with the second conducting leaf 35 when the stem 51 is moved to its set position.

The button 52 is preferably provided with a transparent top wall. The coil spring 53 is electrically conductive and is arranged such that its upper end contacts the leg of the lamp 70 while its lower end contacts the tab portion 12*b* of the second terminal 12, as shown in FIG. 2.

The heart-shaped stepping recess 512 is of a structure like the power cutting member (72) disclosed in the U.S. Pat. No. 5,786,742 and thus its detailed description is omitted herein. The disclosure of such a patent is incorporated herein by reference. The locating cantilever 54 is of a U shape having an upper hand and a lower hand. The upper hand of the locating cantilever 54 is pivotally inserted into a hole formed in the holder 3*b* while the lower hand thereof is slidably inserted into the heart-shaped stepping recess 512. The lower hand of the locating cantilever 54 will be kept inserting into the heart-shaped stepping recess 512 by a biasing spring 56.

The rocking lever 55 is provided with a forcing hole (not designated) as well as a resting tail 55*a* and a nose 55*b* respectively located at two sides of the forcing hole. The forcing hole of the rocking lever 55 can be penetrated by the snap catch 513 so that the rocking lever 55 can pivot around or be moved by the snap catch 513. The nose 55*b* functions to depress the dome 31*b* provided on the first conducting leaf 31 if the resting tail 55*a* is supported by the enabling lever 81 and if the stem 51 is pushed downward to its set position.

The enabling lever 81 has two ends and is pivotally mounted on the snap shaft 3*e* via a hole formed therein. The enabling lever 81 is further provided with an engaging head 81*a* located at one end thereof for engaging with the working end of the bimetal sheet 33, and an enabling rest 81*b* located at the other end thereof for supporting the resting tail 55*a* and thus enabling the rocking lever 55. In a normal status, the enabling lever 81 will be biased toward a supporting position as shown in FIG. 2 by a biasing leaf spring 82. In additional, the enabling rest 81*b* is provided with a platform (not designated) to support the resting tail 55*a* and an oblique lower surface (no designated) for guiding the resting tail 55*a* into its supporting position.

In the follow, the operation of the switch having the above structure will be described. Firstly, the switch shown in FIG. 2 is considered, it being of a normal OFF status when all the elements are assembled into the shell 1. As shown in FIG. 2, the stem 51 is in an ascendant reset position; the upper contact pad 31*c* is apart from the lower contact pad 12*c* and thus the first conducting leaf 31 is in an open position; the upper end of the second conducting leaf 35 is apart from one leg of the resistor 71; the lower hand of the locating cantilever 54 is located at a lower end of the heart-shaped stepping recess 512; and the resting tail 55*a* of the rocking lever 55 is supported by the enabling rest 81*b* and thus the rocking lever 55 is enabled and in an idle position.

Figure 3:
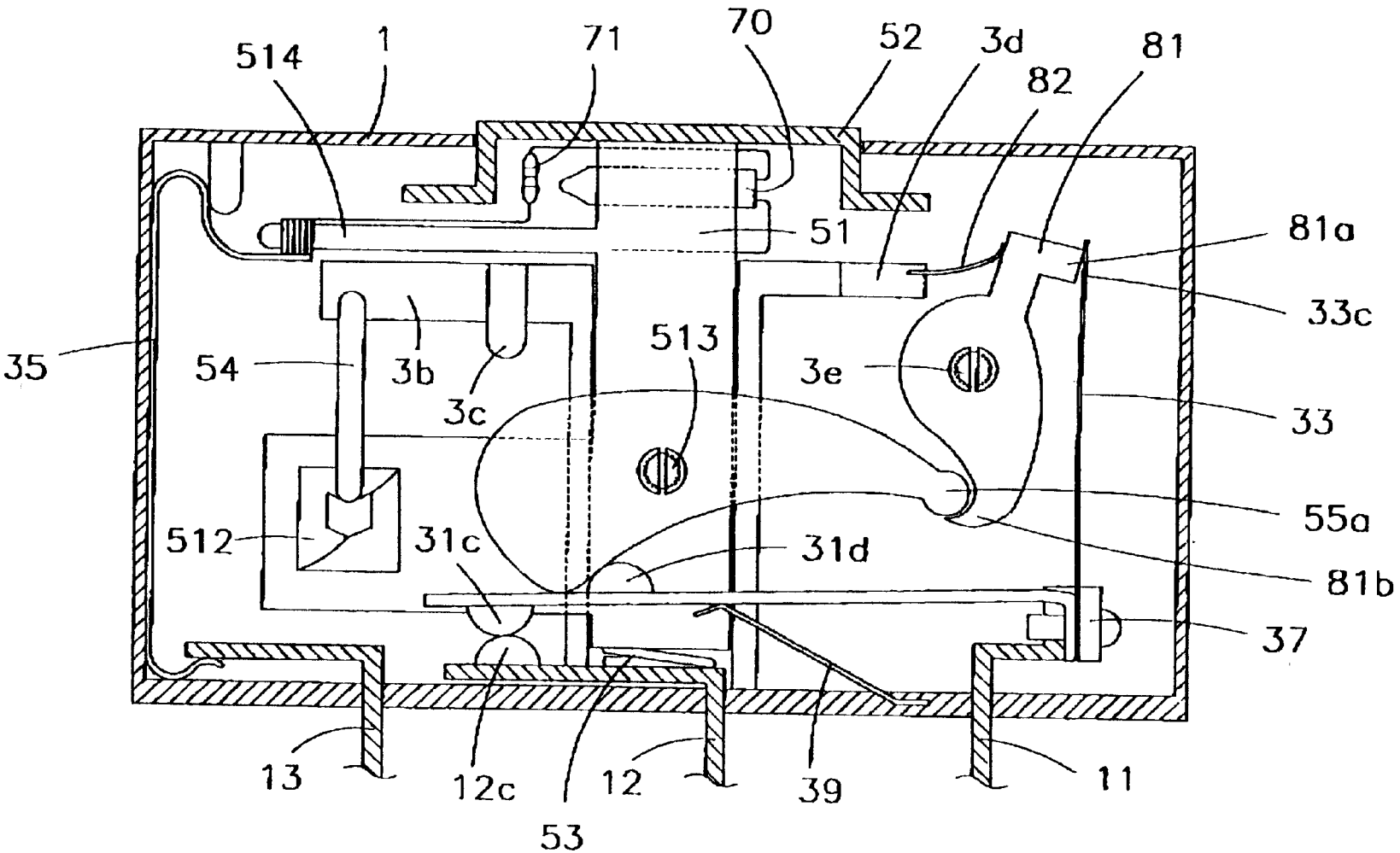
FIG. 3 is a view similar to FIG. 2 except in an ON status.

In case the button 52 is pushed down and thus switches the switch into an ON status, as shown in FIG. 3, the stem 51 is moved downward and the lower hand of cantilever 54 simultaneously slides into an upper notch of the heart-shaped stepping recess 512 and thus locates the stem 51 in its set position. The nose 55*b* is simultaneously moved downward to depress the dome 31*d* of the first conducting leaf 31, resulting from the fact that the resting tail 55*a* is sustained by the enabling rest 81*b* and the forcing hole of the rocking lever 55 is moved downward by the snap catch 513. The rocking lever 55 is thus in an action position, in which the upper contact pad 31*c* provided on the first conducting leaf 31 contacts the lower contact pad 12*c* provided on the second terminal 12 so that an ON status is built. On the other head, the upper end of the second conducting leaf 35 simultaneously contact one leg of the resistor 71 in line with the descent of the stem 51, and thus a conduction between the second and the third terminals 12, 13 is formed via the second conducting leaf 35, the resistor 71, the lamp 70, and the coil spring 53.

During the ON status, in an event of overload, as shown in FIG. 4, the bimetal sheet 33 will snap deflect into a leftward-curved overload position, which concurrently takes the enabling rest 81*b* away from the resting tail 55*a* and into a withdrawing position. In such a situation, the resting tail 55*a* of the rocking lever 55 will descend and the rocking lever 55 is thus disabled. And, the depression of the nose 55*b* upon the first conducting leaf 31 is released. Thus, the first conducting leaf 31 is in an open position in which the first and the second terminals are disconnected from each other. On the other head, even though the second conducting leaf 35 still contact the leg of the resistor 71, the lamp 70 is out of lighting since the second terminal 12 is not provided with power coming from the first terminal 11.

In the above situation, the switch of this invention is in a trip status, and cannot be turned on again until be reset even though the bimetal sheet 33 has returned to its normal position. The switch also cannot be turned on until the bimetal sheet 33 returns to its normal position even though the button 52 along with the stem 51 has been reset, due to a descending distance of the nose 55*b* being insufficient.

When the button is pushed down again after the trip status, proceeding to a manual resetting, the lower hand of the locating cantilever 54 will escape from the upper notch of the heart-shaped stepping recess 512 and thus the stem 51 is moved upward by the spring 53. In the meanwhile, the rocking lever 55 will be further moved upward by the stem 51 and into its idle position, in the light of an upper edge of the rocking lever 55 opposite to the nose being engaged by the lever reseating pin 3*c*. However, the rocking lever 55 will be enabled until the bimetal sheet 33 returns to its normal position. Beside, if the return of the bimetal sheet 33 to its normal position is prior to the return of the rocking lever 55 to its idle position, the provision of the oblique lower surface of the enabling rest 81*b* could promote the pass of the resting tail 55*a*.

On the other head, if the switch is to be turned-off from the ON status in case no overload happens, a push on the stem 51 could make the switch return to its OFF status. That is, in line with a push on the button 52, the lower hand of locating cantilever 54 will escape from the upper notch in the heart-shaped stepping recess 512 and thus the stem 51 can ascend to its reset position under the action of the coil spring 53. The depression of the nose 55*b* on the first conducting leaf 31 is released and thus the first conducting leaf 31 comes into an open position while the leg of the resistor 71 along with the branch 514 is apart from the second conducting leaf 35. Thus, the switch is reset to an OFF status as shown in FIG. 2.

In view of the above, the switch according to this invention can obtain an exact overload protection. However, it should be understood that the omission of the third terminal 13, the second conducting leaf 35, the resistor 71, and the lamp 70 would not affect the practicing and the concept of this invention. Moreover, by means of the provision of the enabling lever 81, the deflecting stroke of the bimetal sheet 33 can be modified and transmitted to the rocking lever 55. Thus, the actuating force or distance of the bimetal sheet could be properly modified and a request to the precise positioning pertinent to the bimetal sheet 33 and the rocking lever 55 could be low, which in turn is of benefit to assembly.

Figure 5:
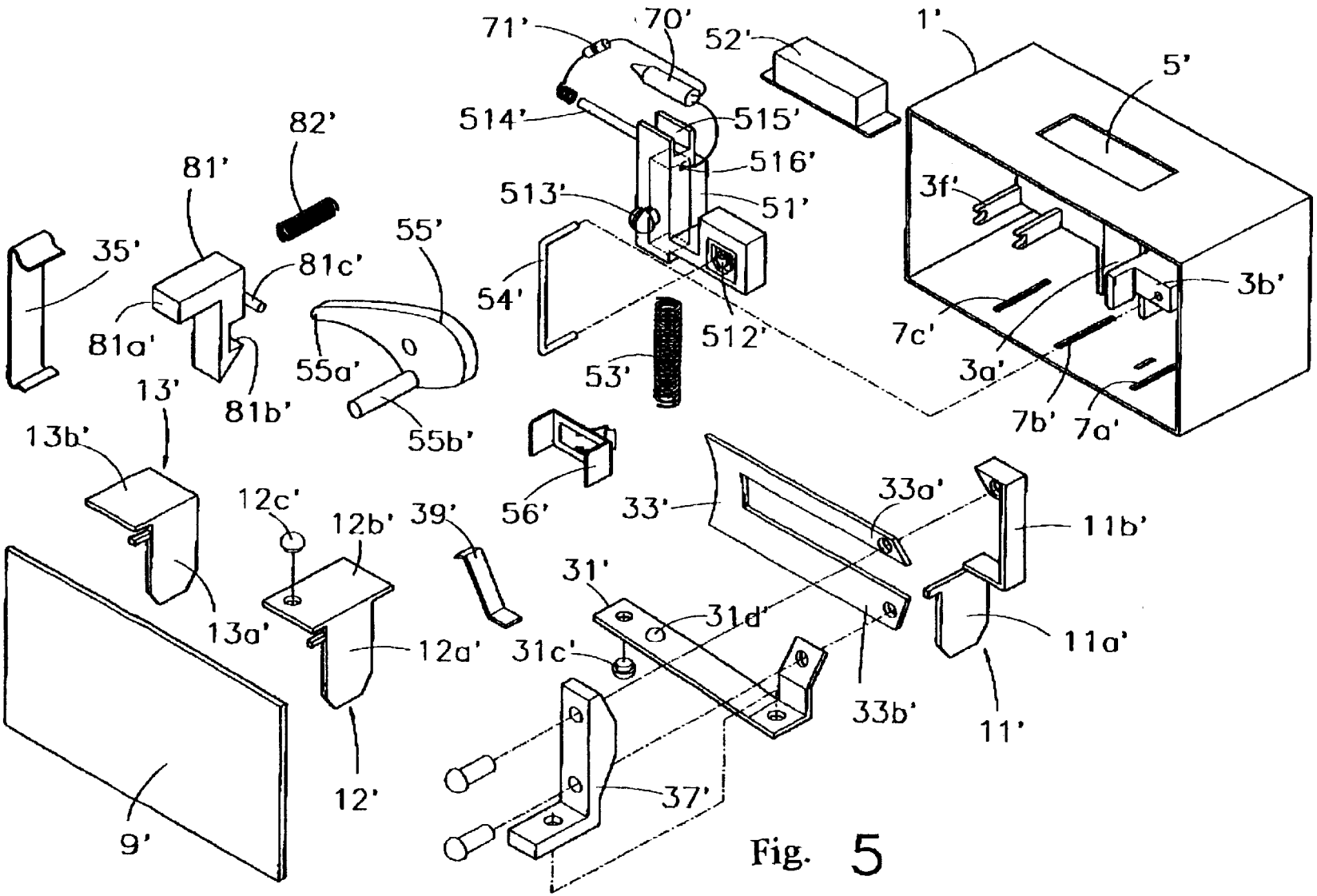
FIG. 5 is a perspective exploded schematic view of a push-button switch with overload protection in accordance with a second embodiment of this invention.

FIG. 5 shows a push-button switch with overload protection in accordance with a second embodiment of this invention. For the benefit of recognition, the parts corresponding to those in the first embodiment are indicated with same numerals and all indicated numerals are attached with a prime symbol.

Figure 6:
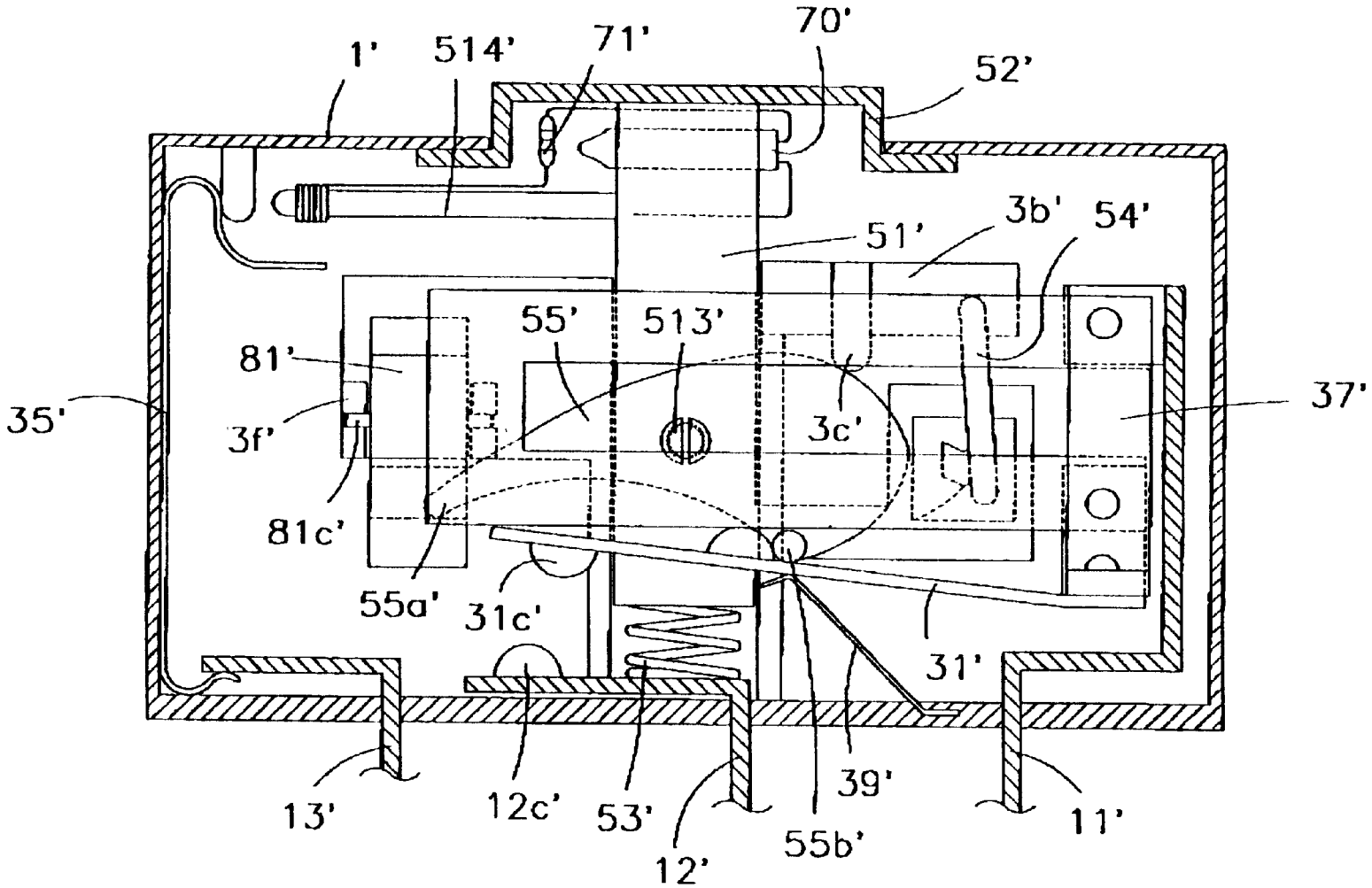
FIG. 6 is an assembled elevation view, partly in section, of the push-button switch of FIG. 7 in an OFF status.

As shown in FIGS. 5 and 6, the bimetal sheet 33' horizontally extends from the right side of the shell 1' to the left side thereof. The rocking lever 55' is also formed with a forcing hole, a resting tail 55*a'* and a nose 55*b'*. However, the nose 55*b'* is in the form of a rod vertically extending frontward from a front surface of the rocking lever 55'. The enabling lever 81' is provided with a rotating shaft, an engaging head 81*a'*, and an enabling rest 81*b'*. However, the rotating shaft of the enabling lever is in the form of a rod extending horizontally from the left side to the right side, and is rotably mounted on a bracket 3*f'* integrally formed on the shell 1'. The platform of the enabling rest 81*b'* on which the resting tail 55*a'* rests is in the form of a slot opening backward. The enabling lever 81' is pushed frontward to a supporting position by the coil spring 82' in case the bimetal sheet 33' is not in an overload position. The other components of this embodiment, as shown in FIG. 5, is substantially the same with those disclosed in the first embodiment and thus their introductions are omitted herein.

Figure 7:
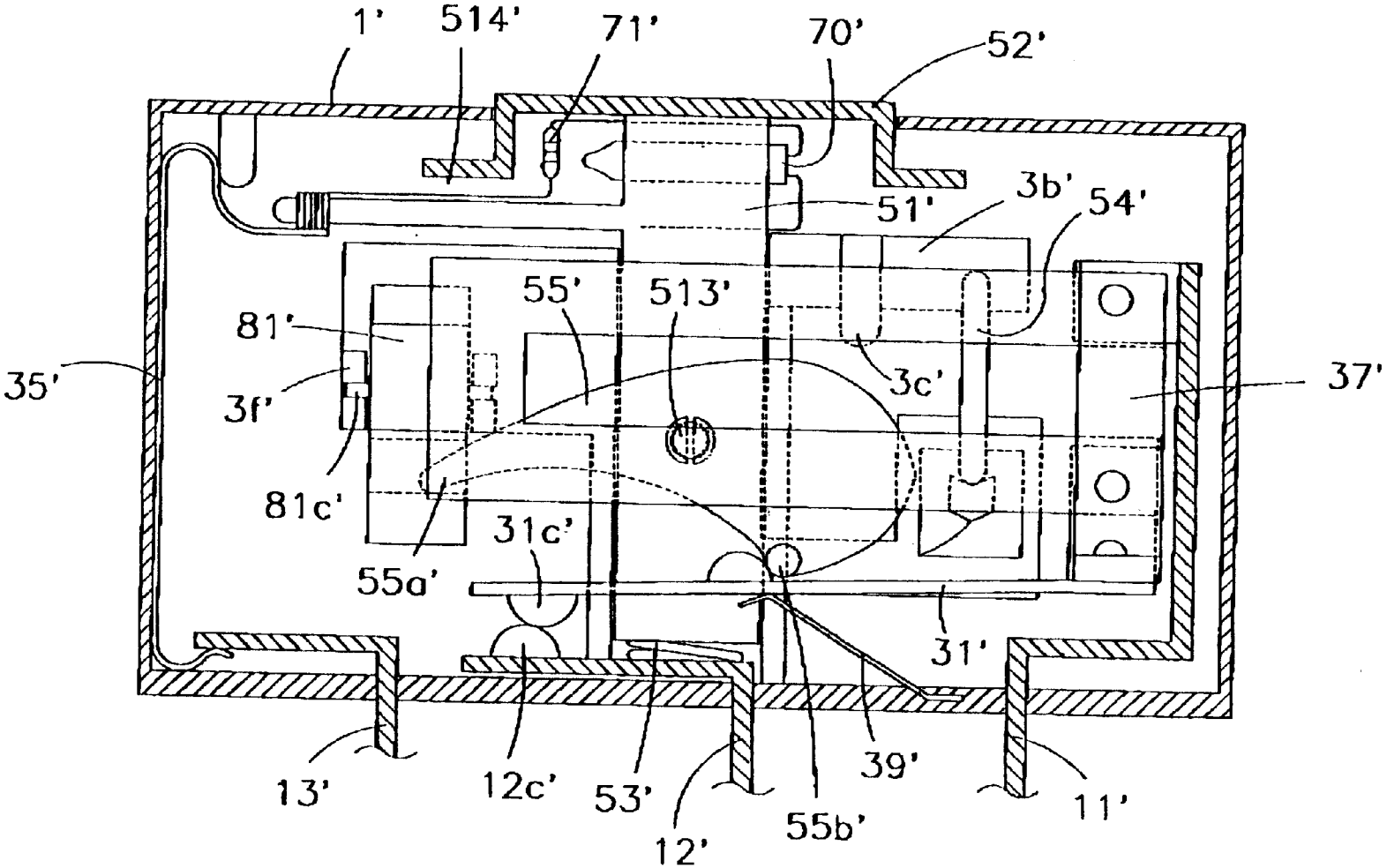
FIG. 7 is a view similar to FIG. 8 except in an ON status.
Figure 8:
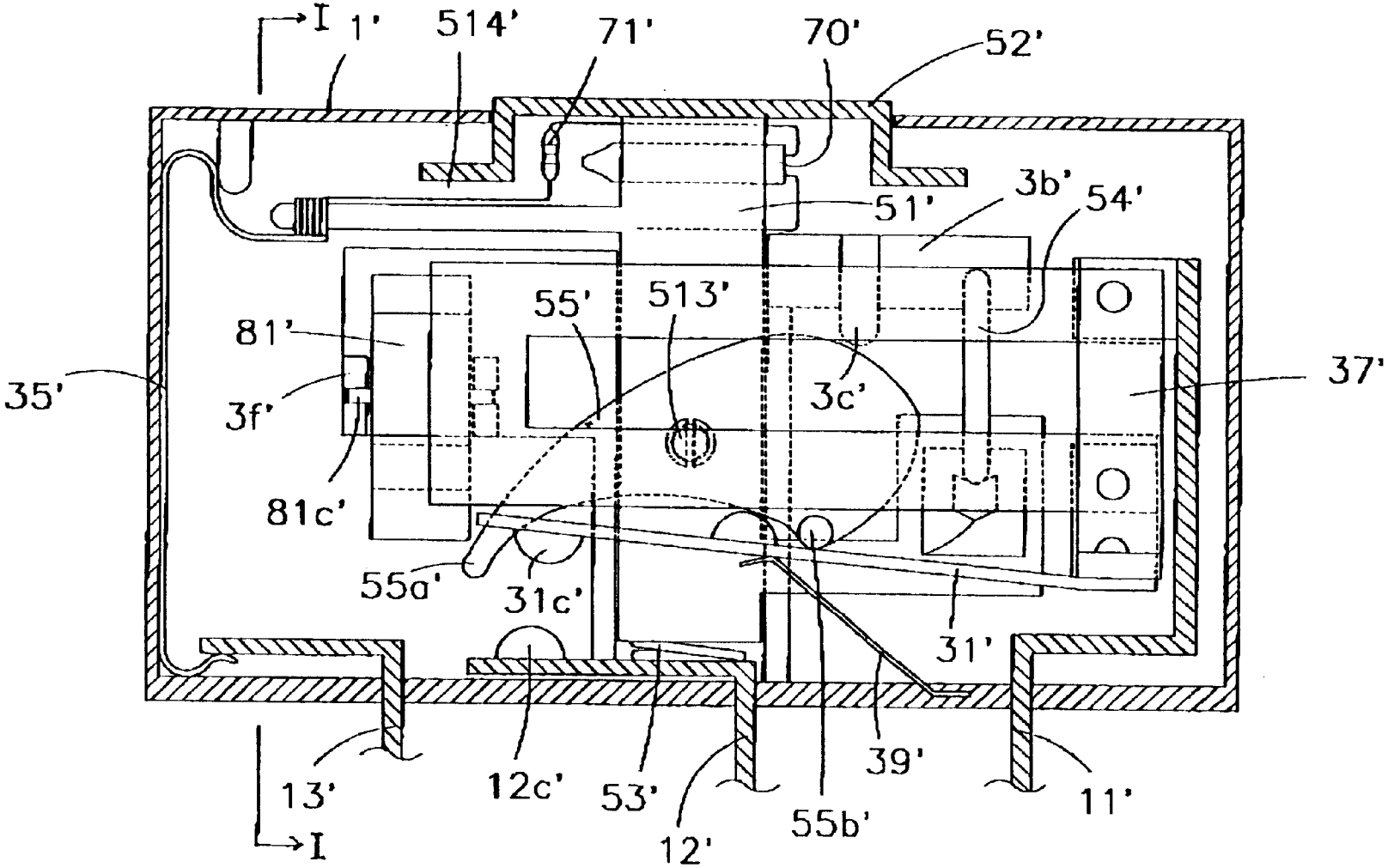
FIG. 8 is a view similar to FIG. 8 except in a trip status.

As for the operating manner and the function of the switch disclosed in the second embodiment, they are also substantially the same with those disclosed in the first embodiment. FIGS. 6, 7, and 8 respectively show an OFF status, an ON status, and a trip status of the switch in this embodiment.

Figure 9:
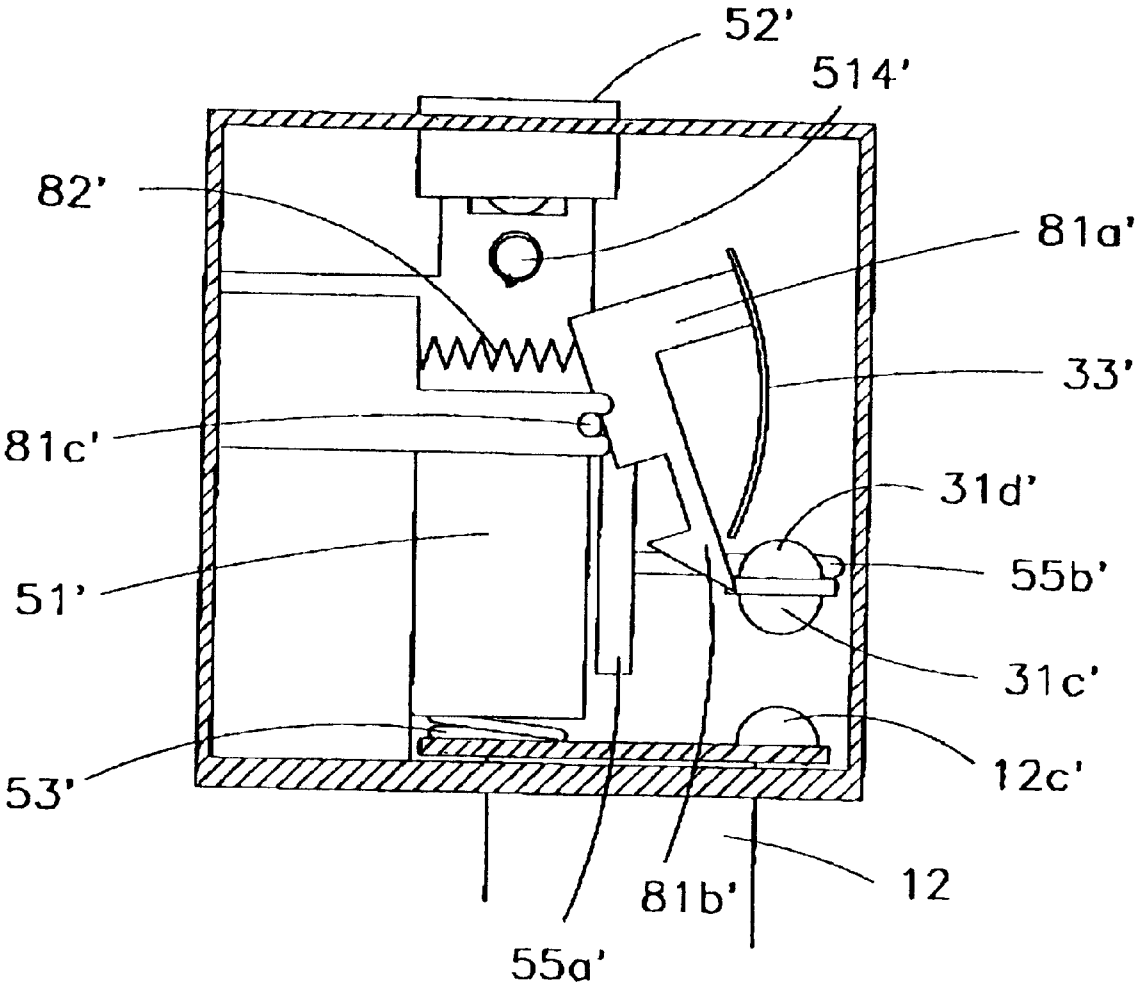
FIG. 9 is a sectional side view taken along a line I—I of FIG. 8.

As shown in FIG. 6, in an OFF status, the contact pads 31*c*' and 12*c*' are apart from one other; the resting tail 55*a*' is supported by the enabling rest 81*b*' and thus the rocking lever 55' is enabled. In an On status, as shown in FIG. 7, the resting tail 55*a*' is still supported by the enabling rest 81*b*' and thus the nose 55*b*' is able to depress the first conducting leaf 31' into a closed position in which the contact pads 31*c*' and 12*c*' contact each other. In a trip status, as shown in FIGS. 8 and 9, the bimetal sheet 33' changes to an overload position in which the surface of the working end thereof bends backward and pushes the engaging head 81*a*' of the enabling lever 81' into a withdrawing position against the coil spring 82'. In such a situation, the resting tail 55*a*' is not supported and thus the rocking lever 55' is disabled. The depression of the nose 55*b*' on the first conducting leaf 31' is released. The circuit between the first and the second terminals is thus disconnected.

The resetting procedure of the second embodiment is the same with that in the first embodiment. Moreover, the switch cannot be turned on again until a resetting procedure has been done even though the bimetal sheet 33 has returned to its normal position. The switch also cannot be turned on until the bimetal sheet 33 returns to its normal position even though the button 52 along with the stem 51 has been reset, due to a descending distance of the nose 55*b* being insufficient.

While the present invention is described by way of preferred embodiments, it should be understood that the embodiments are used only to illustrate the technical concept of the present invention without limiting the scope thereof. It is therefore intended that all modifications and alterations that are readily apparent to those skilled in the art be within the scope as defined in the appended claims.

What is claimed is:

1. A push-button switch of overload protection, comprising:

a housing;

a conducting unit installed in the housing and including a first terminal, a second terminal, a first conducting leaf, and a flat bimetal sheet; the bimetal sheet having a movable working end, being able to deflect to an overload position upon overload from the normal position, and a fixed opening end formed with a first and a second legs for respectively connecting with the first terminal and the first conducting leaf; the first conducting leaf being movable between a normal-open position in which the second leg is disconnected from the second terminal and a closed position in which the second leg is electrically connected to the second terminal; and an actuating unit installed in the housing and including:

a stem to be actuated;

a positioning means includes a heart-shaped stepping recess and a locating cantilever for alternatively locating the stem in an upper reset position and a lower set position with respect to the housing;

a rocking lever pivotally supported on the stem along a pivoting axle and formed with a nose for depressing the first conducting leaf and a resting tail opposite to the nose across the pivoting axle;

an enabling lever pivotally mounted on the housing and formed with an engaging head for engaging with the working end of the bimetal sheet, and an enabling rest for supporting the resting tail so as to enable the rocking lever; and a lever reseating member for pushing the rocking lever into an idle position in which the resting tail can be supported by the enabling rest, during a reset course in which the stem moves from the set position to the reset position;

whereby the nose can depress and release the first conducting leaf so as to make the latter move into the closed position and the normal-open position in response to the movement of the stem to its set position and its reset position, respectively, in case the resting tail is supported by the enabling rest, and whereby the first conducting leaf can move to its normal-open position in response to a change of the bimetal sheet into its overload position.

2. The switch according to claim 1, wherein the first and second legs have respective planar surfaces, being angled to each other.

3. The switch according to claim 1, wherein the heart-shaped stepping recess is integrally formed with the stem, and the locating cantilever is provided with a first hand mounted in the housing and a second hand slidably inserting into the heart-shaped stepping recess.

4. The switch according to claim 1, wherein the conducting unit further comprises a third terminal, a lamp having two pins to be connected with the second and the third terminals respectively, and a second conducting leaf having one end connecting with the third terminal; and wherein the stem is provided with a branch to carry one pin of the lamp into conduction with the second conducting leaf.

5. The switch according to claim 1, wherein the enabling rest is provided with a platform for supporting the resting tail and an oblique lower surface for guiding the resting tail.

* * * * *

UNITED STATES PATENT AND TRADEMARK OFFICE

CERTIFICATE OF CORRECTION

PATENT NO. : 6,512,441 B1
DATED : January 28, 2003
INVENTOR(S) : Yu

It is certified that error appears in the above-identified patent and that said Letters Patent is hereby corrected as shown below:

Title page,
Item [*] Notice: Subject to any disclaimer, the term of this patent is extended or adjusted under 35 USC 154(b) by (320) days
Delete the phrase "by 320 days" and insert -- by 225 days --

Signed and Sealed this

Twenty-fifth Day of November, 2003

JAMES E. ROGAN
*Director of the United States Patent and Trademark Office*